US008702473B1

(12) United States Patent
Lyons

(10) Patent No.: US 8,702,473 B1
(45) Date of Patent: Apr. 22, 2014

(54) ROCK POLISHING SYSTEMS AND METHODS

(71) Applicant: Gordon Lyons, Arlington, WA (US)

(72) Inventor: Gordon Lyons, Arlington, WA (US)

( * ) Notice: Subject to any disclaimer, the term of this patent is extended or adjusted under 35 U.S.C. 154(b) by 0 days.

(21) Appl. No.: 13/784,679

(22) Filed: Mar. 4, 2013

(51) Int. Cl.
*B24B 1/00* (2006.01)

(52) U.S. Cl.
USPC ..... 451/41; 451/286; 125/30.01

(58) Field of Classification Search
USPC ..... 125/30.01; 451/41, 286
See application file for complete search history.

(56) References Cited

U.S. PATENT DOCUMENTS

| | | | | | |
|---|---|---|---|---|---|
| 970,227 | A | * | 9/1910 | Homan | 451/279 |
| 2,209,071 | A | | 7/1940 | Bullard | |
| 2,419,739 | A | | 4/1947 | Spina | |
| 2,565,590 | A | | 8/1951 | Bullard | |
| 2,627,144 | A | | 2/1953 | Roshong | |
| 2,782,571 | A | | 2/1957 | Hanson | |
| 2,870,580 | A | * | 1/1959 | Norton | 451/286 |
| 3,111,791 | A | * | 11/1963 | Harris et al. | 451/286 |
| 3,267,618 | A | * | 8/1966 | Giezentanner | 451/286 |
| 3,374,582 | A | | 3/1968 | Boettcher | |
| 3,377,750 | A | | 4/1968 | Day | |
| 3,568,371 | A | | 3/1971 | Day et al. | |
| 3,570,188 | A | | 3/1971 | Ebner | |
| 3,680,265 | A | | 8/1972 | McClure | |
| 4,043,081 | A | * | 8/1977 | DeTray | 451/286 |
| 8,079,894 | B2 | | 12/2011 | Tolles et al. | |
| 2001/0044266 | A1 | | 11/2001 | Katsuoka et al. | |

* cited by examiner

*Primary Examiner* — Maurina Rachuba
(74) *Attorney, Agent, or Firm* — Michael R. Schacht; Schacht Law Office, Inc.

(57) ABSTRACT

A polishing system for polishing a flat face of a rock comprises a polishing surface, a fence system, and a drive system. The polishing surface is supported for rotation about a primary rotation axis. The fence system is supported above the polishing surface. The drive system causes the polishing surface to rotate about the primary rotation axis and displace a driven portion of the fence system along a path relative to the primary rotation axis. The fence system engages the rock to prevent the polishing surface from causing the rock to move about the primary rotation axis and to cause the rock to move towards and away from the primary rotation axis.

21 Claims, 10 Drawing Sheets

ROCK POLISHING SYSTEMS AND METHODS

TECHNICAL FIELD

The present invention relates to rock polishing systems and methods and, more particularly, to rock polishing systems and methods adapted to polish the flat face of a cut rock.

BACKGROUND

Polishing rocks can significantly improve the aesthetics of the rock. Rock tumblers polish the surface of rocks having irregular shapes. When rocks are cut to reveal a flat face, the flat face of the rock is best polished using a flat polishing surface.

One system for polishing the flat face of a rock employs a rotating disc on which the polishing surface is formed. A rock to be polished is placed on the rotating disc with its flat face down and supported such that the polishing surface moves relative to the rock. The polishing process takes a significant amount of time, and a problem arises when, over time, the movement of the polishing surface relative to the rock becomes too regular. In particular, regular linear or arcuate movement of the polishing surface relative to the flat face can wear visible grooves or patterns into the flat face. Such grooves are unsightly and can ruin the appearance of the flat face.

The need thus exists for improved rock polishing systems and methods that inhibit the formation of unsightly grooves or patterns in rocks.

SUMMARY

The present invention may be embodied as a polishing system for polishing a flat face of a rock comprising a polishing surface, a fence system, and a drive system. The polishing surface is supported for rotation about a primary rotation axis. The fence system is supported above the polishing surface. The drive system causes the polishing surface to rotate about the primary rotation axis and displace a driven portion of the fence system along a path relative to the primary rotation axis. The fence system engages the rock to prevent the polishing surface from causing the rock to move about the primary rotation axis and to cause the rock to move towards and away from the primary rotation axis.

A method of polishing a flat face of a rock comprises the following steps. A polishing surface is supported for rotation about a primary rotation axis. A fence system is supported above the polishing surface. The polishing surface is caused to rotate about the primary rotation axis. A driven portion of the fence system is displaced along a path relative to the primary rotation axis such that the rock is prevented from moving about the primary rotation axis and caused to move towards and away from the primary rotation axis.

The present invention may also be embodied as a polishing system for polishing a flat face of a rock comprising a support assembly, a table system, a fence system, and a drive system. The table system comprises a support disc and a polishing sheet secured to the support disc to define a polishing surface. The support disc is supported for rotation relative to the support assembly. The fence system comprises a fence plate, at least one fence arm rigidly connected to a first end to the fence plate, and at least one fence hinge for movably supporting the fence above the polishing surface. The drive system causes the polishing surface to rotate about the primary rotation axis and displaces a driven portion of the fence system along a path relative to the primary rotation axis. The fence system engages the rock to prevent the polishing surface from causing the rock to move about the primary rotation axis and cause the rock to move towards and away from the primary rotation axis.

DETAILED DESCRIPTION

Figure 1:
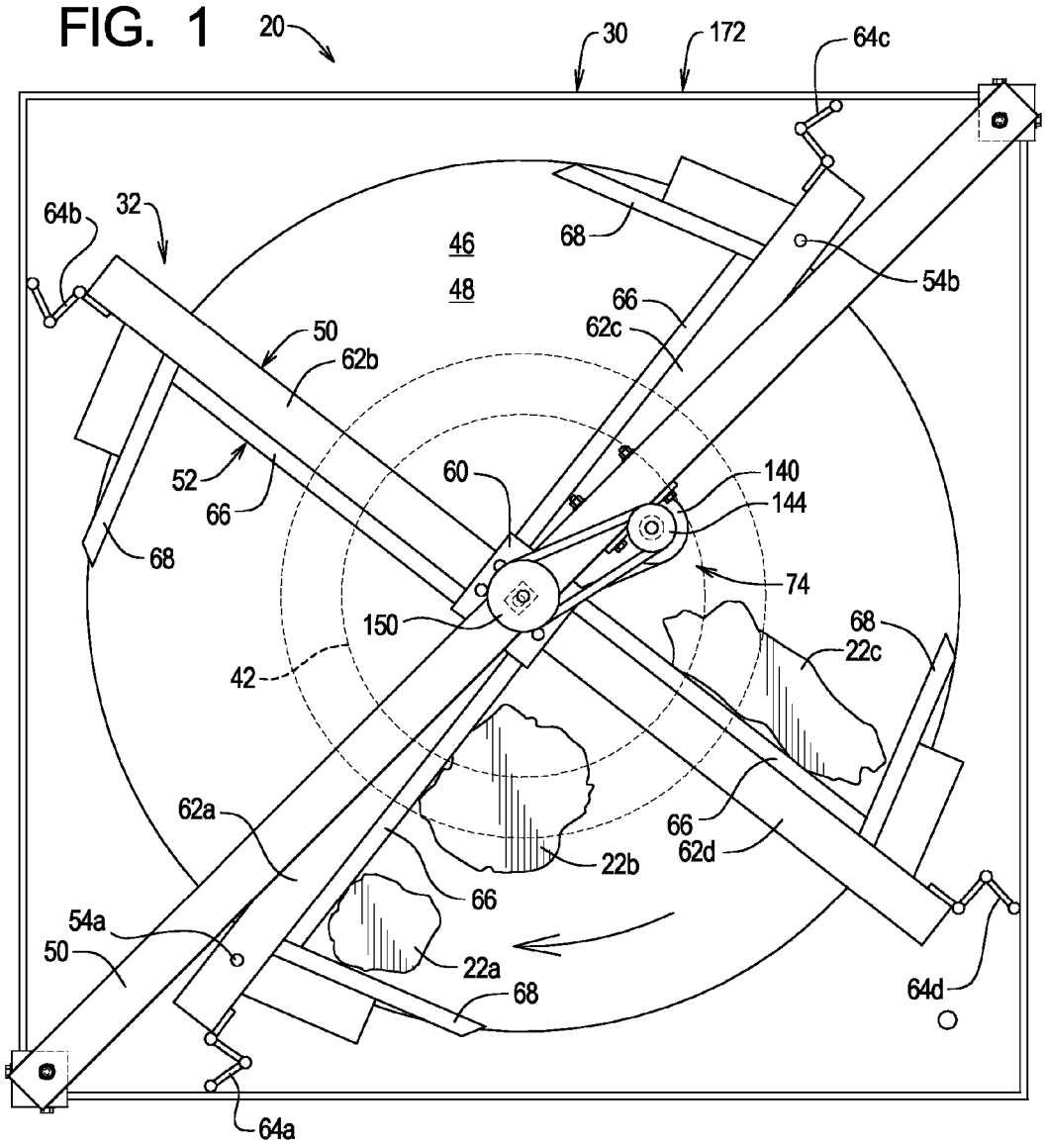
FIG. 1 is a top plan view of an example rock polishing system of the present invention.
Figure 2:
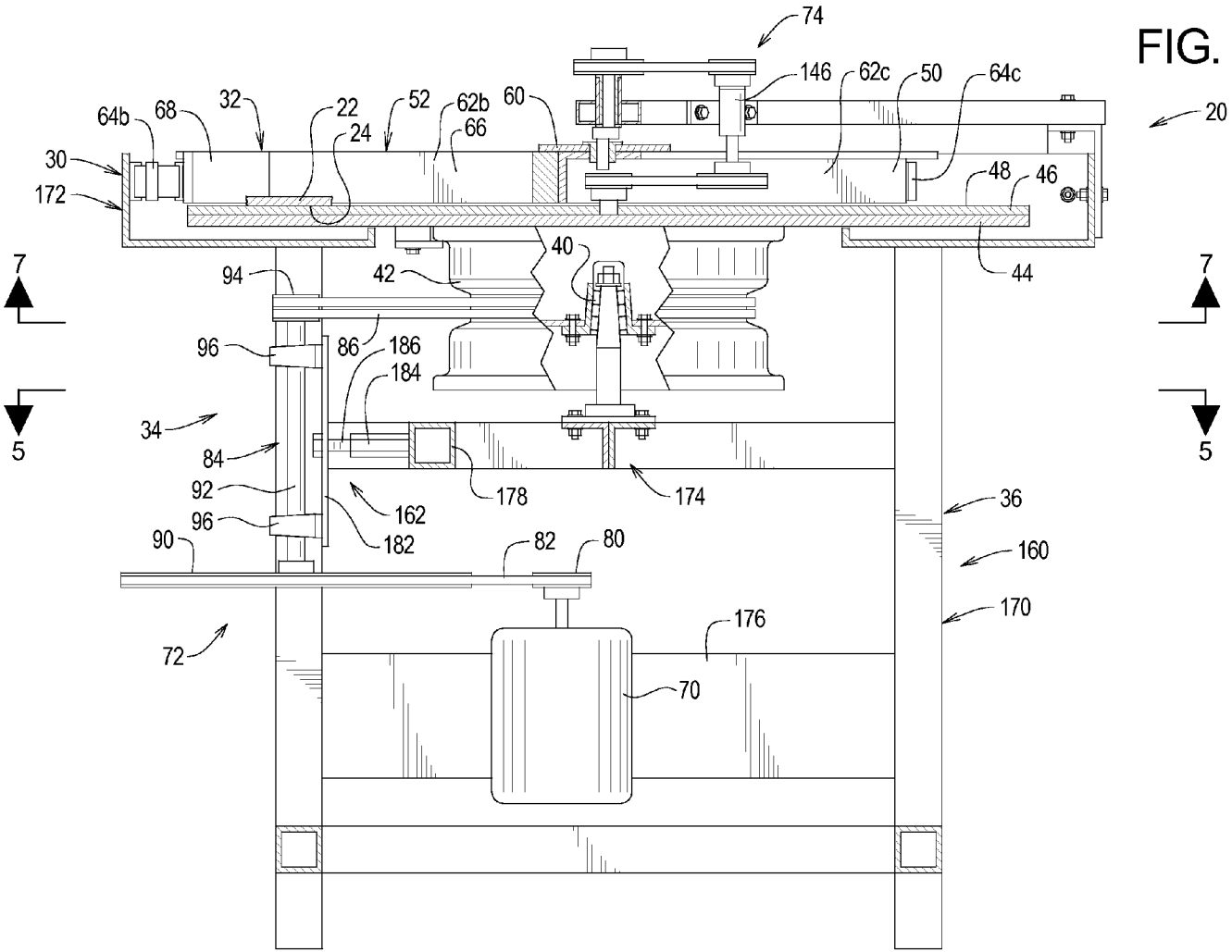
FIG. 2 is a side elevation view depicting the example rock polishing system of the present invention.
Figure 3:
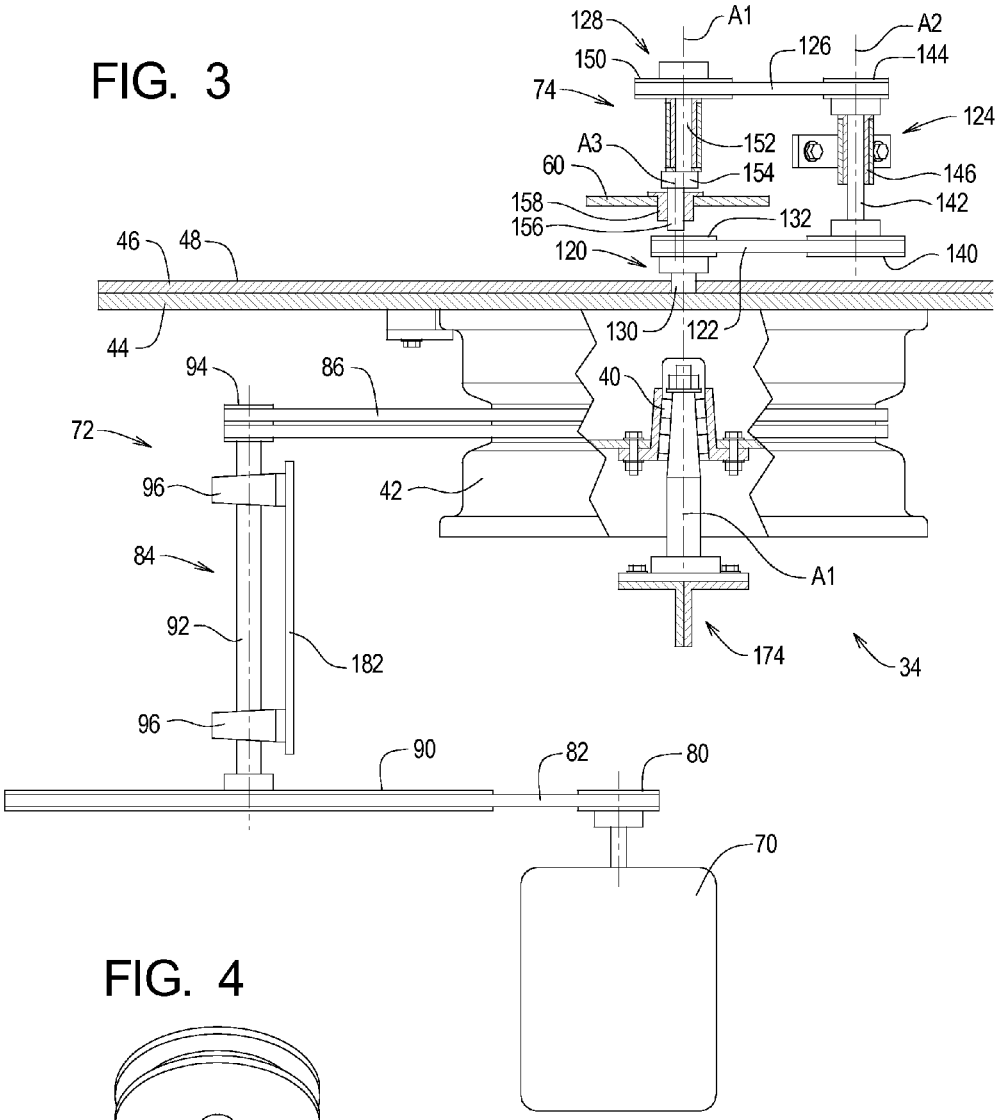
FIG. 3 is a side elevation view depicting a drive system of the example rock polishing system of the present invention.
Figure 4:
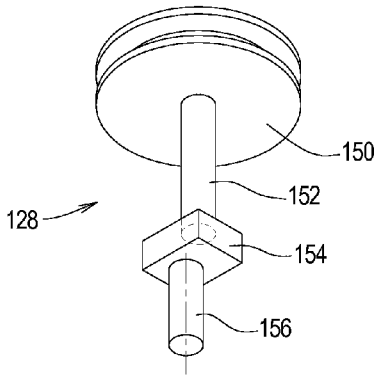
FIG. 4 is a perspective view of a fence drive shaft assembly of the example rock polishing system of the present invention.

Referring initially to FIGS. 1-3 of the drawing, depicted therein is an example polishing system 20 constructed in accordance with, and embodying, the principles of the present invention. The example polishing system 20 is configured to polish one or more rocks 22 each defining at least one flat face 24 (FIG. 2). The example polishing system 20 is polishing first, second, and third rocks 22*a*, 22*b*, and 22*c*.

At this point, it should be noted that numerical reference characters used in this application without letter suffixes refer to components generically, while the same numerical reference characters used with letter suffixes refer to specific components of the examples depicted in the drawing. In this context, any numerical reference character used in the written specification without an appended letter suffix is supported by that same numerical reference character used with an appended letter suffix in the drawing.

The example polishing system 20 comprises a table system 30, a fence system 32, a drive system 34, and a support assembly 36. In general, the support assembly 36 supports the drive system 34 and table system 30 such that drive system 34 rotates at least a portion of the table system 30. The support assembly 36 further supports the drive system 34 and the fence system 32 such that the drive system 34 displaces at least a portion of the fence system 32 relative to the table system 30.

The example table system 30 comprises a drum bearing 40, a drive drum 42, a support disc 44, and a polishing sheet 46. The drum bearing 40 is secured to the support assembly 36 to define a primary rotation axis A1. The example primary rotation axis A1 is substantially vertical. The drive drum 42 is operatively connected to the drum bearing 40 such that at longitudinal axis of the drive drum 42 is aligned with the primary rotation axis A1 and such that the drive drum 42 freely rotates about the primary rotation axis A1 relative to the support assembly 36. The example support disc 44 is a substantially circular member made of material capable of supporting the weight of the rocks 22 as will be described in further detail below. The support disc 44 is supported by the drive drum 42 such that an axis of the support disc 44 is aligned with the primary rotation axis A1 and such that rotation of the drive drum 42 is transmitted to the support disc 44. The polishing sheet 46 is sized and dimensioned substantially to cover an upper surface of the support disc 44 and secured to the support disc such that rotation of the support disc 44 is transmitted to the polishing sheet 46. The polishing sheet 46 defines a polishing surface 48 on which the rocks 22 are placed during operation of the example rock polishing system 20 as shown in FIGS. 1 and 2. The polishing sheet 46 can take a number of forms, but the inventor has determined that Berber carpet exhibits good polishing characteristics, adequate wear resistance, and low cost.

The example fence system 32 comprises a crossarm 50 and a fence assembly 52. The example crossarm 50 is rigidly supported by the support assembly 36 such that the crossarm 50 is substantially parallel to and spaced above the polishing surface 48. Stop projections 54 extend from the fence assembly 52 as will be described in further detail below. The example fence assembly 52 comprises a fence plate 60, one or more fence arms 62, and one or more fence hinge assemblies 64. The example fence assembly 52 as depicted in FIG. 1 comprises four fence arms 62*a*, 62*b*, 62*c*, and 62*d* and four fence hinge assemblies 64*a*, 64*b*, 64*c*, and 64*d*. In the example fence assembly 52, first and second projections 54*a* and 54*b* extend from the fence arms 62*a* and 62*c*, respectively. These stop projections 54*a* and 54*b* engage the crossarm 50 to inhibit excessive movement of the fence assembly 52 relative to the crossarm 50 as will be described in further detail below.

Each of the fence arms 62 is connected at a first end by the fence plate 60 and at a second end to the support assembly 36 by one of the fence hinge assemblies 64. The fence plate 60 rigidly connects the fence arms 62 to each other to form a rigid arm assembly.

The fence hinge assemblies 64 support the rigid arm assembly for movement within a limited range relative to the support assembly 36. The fence hinge assemblies 64 further support the rigid arm assembly such that the fence arms 62 are substantially parallel to and spaced above the polishing surface 48. The example hinge assemblies 64 define three hinge pins and thus three pivot points to allow circular movement of the distal ends of the fence arms 62 and thus of the entire fence assembly 52. The stop projections 54*a* and 54*b* extending from the fence arms 62*a* and 62*c*, respectively, engage the crossarm 50 to prevent excessive movement of the fence assembly 52 relative to the crossarm 50.

One alternative to the hinge assemblies 64 include a resilient member connected between the distal ends of the fence arms 62 and the support assembly 36 to allow similar circular movement of the fence assembly 52 while maintaining the fence assembly 52 in a desired orientation with respect to the polishing surface 48. Another alternative is simply to rest the distal ends on a fixed portion of the support assembly such that the fence assembly 52 is supported in a desired orientation with respect to the polishing surface 48 but is free to rotate as described herein.

In the example fence system 32, a first fence board 66 and a second fence board 68 are rigidly attached to each of the fence arms 62 such that the fence boards 66 and 68 are substantially parallel to and spaced above the polishing surface 48. The example fence arms 62 and first fence boards 66 extend from approximately the primary rotation axis A1 to a perimeter circular edge of the support disc 44 and are generally parallel to a radial line extending from the primary rotation axis A1. The second fence boards 68 are supported adjacent to the perimeter circular edge of the support disc 44 and are generally perpendicular to a radial line extending from the primary rotation axis A1.

Turning now to FIG. 3 of the drawing, the example drive system 34 will now be explained in further detail. The example drive system 34 comprises a motor 70, a primary transmission system 72, and a secondary transmission system 74.

The primary transmission system 72 comprises a motor pulley 80, a motor belt 82, a primary shaft assembly 84, and a drum belt 86. The primary shaft assembly 84 comprises a first primary pulley 90, a primary drive shaft 92, a second primary pulley 94, and primary bearings 96. The motor belt 84 is arranged to transfer rotation of the motor pulley 80 to the first primary pulley 90. Rotation of the first primary pulley 90 is transferred to the second primary pulley 94 by the primary drive shaft 92. The drum belt 86 is arranged to transfer rotation of the second primary pulley 94 to the drive drum 42. Operation of the motor 70 rotates the motor pulley 80 which results in rotation of the drive drum 42 and thus the support disc 44.

The relative diameters of the pulleys and rotational speed of the motor pulley 80 dictates the rotational speed of the support disc 44 (table rotational speed). These parameters are typically selected to obtain a table rotational speed of approximately 34 rpm and in any event should be within a first range of 32-36 rpm or in a second range of 28-40 rpm.

Referring again to FIG. 3 of the drawing, the secondary transmission system 74 will now be described in further detail. The example secondary transmission system 74 comprises a disc pulley assembly 120, a first secondary drive belt 122, a secondary shaft assembly 124, a second secondary drive belt 126, and a fence shaft assembly 128.

The disc pulley assembly 120 comprises a disc spindle 130 and a disc pulley 132. The example disc spindle 130 is supported by the support disc 44 such that a longitudinal axis of the disc spindle 130 is aligned with the primary rotation axis A1 and such that rotation of the support disc 44 is transmitted to the disc spindle 130. The disc pulley 132 is mounted on the disc spindle 130 such that a rotational axis of the disc pulley 132 is also aligned with the primary rotation axis A1 and such that rotation of the disc spindle 130 is transmitted to the disc pulley 132.

The example secondary shaft assembly 124 comprises a first secondary pulley 140, a secondary drive shaft 142, a second secondary pulley 144, and a secondary bearing 146. The first and second secondary pulleys 140 and 144 are mounted on either end of the secondary drive shaft 142. The secondary bearing 146 supports the secondary drive shaft 142 to the crossarm 50 to define a first secondary rotation axis A2 that is substantially parallel to the primary rotation axis A1. The secondary bearing 146 allows axial rotation of the secondary drive shaft 142 about the secondary drive axis A2 relative to the crossarm 50. The secondary bearing 146 supports the secondary drive shaft 142 such that first secondary pulley 140 is substantially coplanar with the disc pulley 132 and the second secondary pulley 144 is located above the crossarm 50. The first secondary drive belt 122 is arranged to transmit rotation of the disc pulley 132 to the first secondary pulley 140.

The example fence shaft assembly 128 comprises a fence pulley 150, a fence drive shaft 152, a fence offset member 154, an orbital drive shaft 156, and a fence bearing 158. The fence pulley 150 and offset member 154 are mounted on the fence drive shaft 152. The fence bearing 158 supports the fence drive shaft 152 on the crossarm 50 such that a longitudinal axis of the fence drive shaft 152 is substantially aligned with the primary rotation axis A1 and allows axial rotation of the fence drive shaft 152 about primary rotation axis A1 relative to the crossarm 50. The fence bearing 158 further supports the fence drive shaft 152 such that fence pulley 150 is substantially coplanar with the second secondary pulley 144. The second secondary drive belt 122 is arranged to transmit rotation of the second secondary pulley 144 to the fence pulley 150.

The fence offset member 154 is rigidly connected to an opposite end of the fence drive shaft 152. The orbital drive shaft 156 defines an orbital axis A3 and is rigidly connected to the fence offset member 154 such that the orbital axis A3 is substantially parallel to but is spaced a distance from the primary rotation axis A1. Further, rotation of the fence drive shaft 152 causes the orbital axis A3 to move or orbit along a circular path around the primary rotation axis A1.

The orbital drive shaft 156 is in turn operatively connected to the fence plate 60 such that the orbital drive shaft 156 causes the fence plate 60 to move along the circular path followed by the orbital drive shaft 156. In the example polishing system 20, the fence plate 60 thus defines a driven portion of the fence system 32. Further, the fence plate 60 and orbital drive shaft 156 rotate relative to each other such that interaction of the fence plate 60 and the orbital drive shaft 156 does not apply a rotating force on the fence arms 62.

The relative diameters of the pulleys and rotational speed of the support disc 44 dictates the rotational speed of the fence plate 60 (orbital rotational speed). These parameters are typically selected to obtain an orbital rotational speed of approximately 12 rpm and in any event should be within a first range of 10-14 rpm or in a second range of 2-20 rpm.

Figure 5:
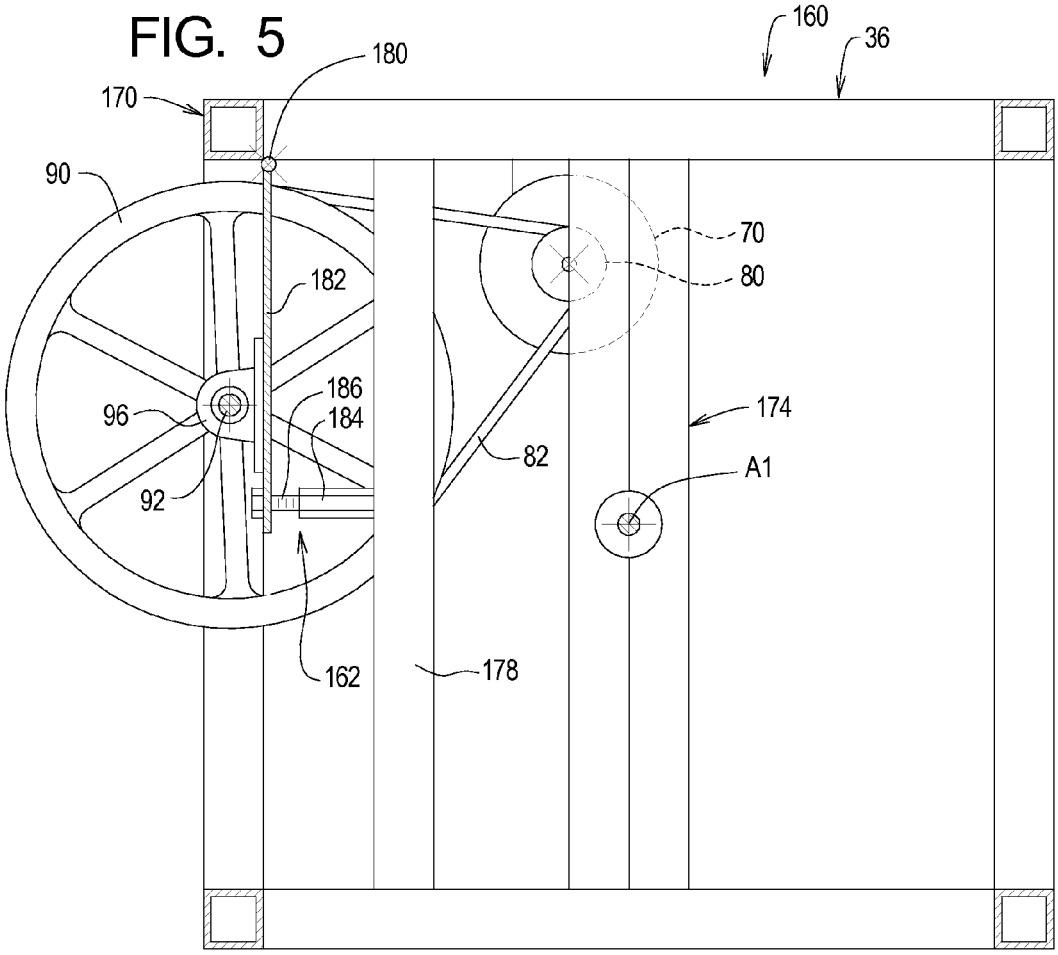
FIG. 5 is a section view taken along lines 5-5 in FIG. 2 illustrating a primary transmission mounting assembly in a first position.
Figure 6:
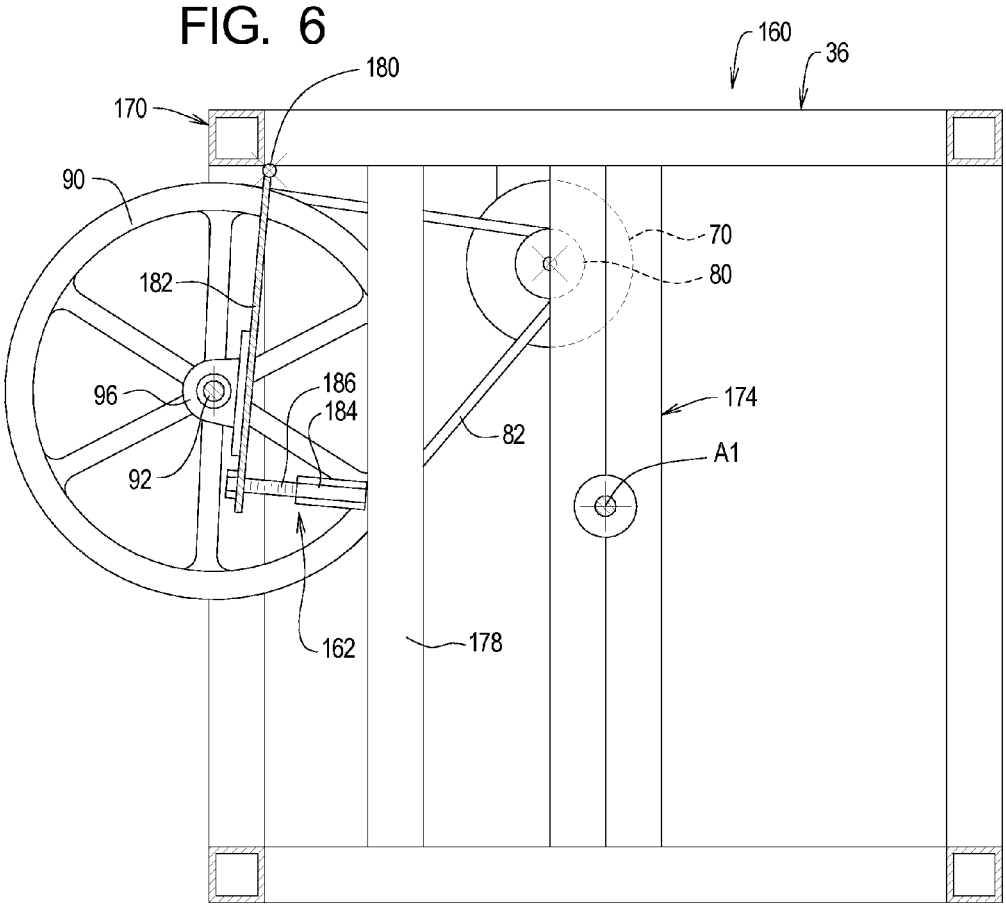
FIG. 6 is a section view similar to FIG. 5 illustrating the primary transmission mounting assembly in a second position.
Figure 7:
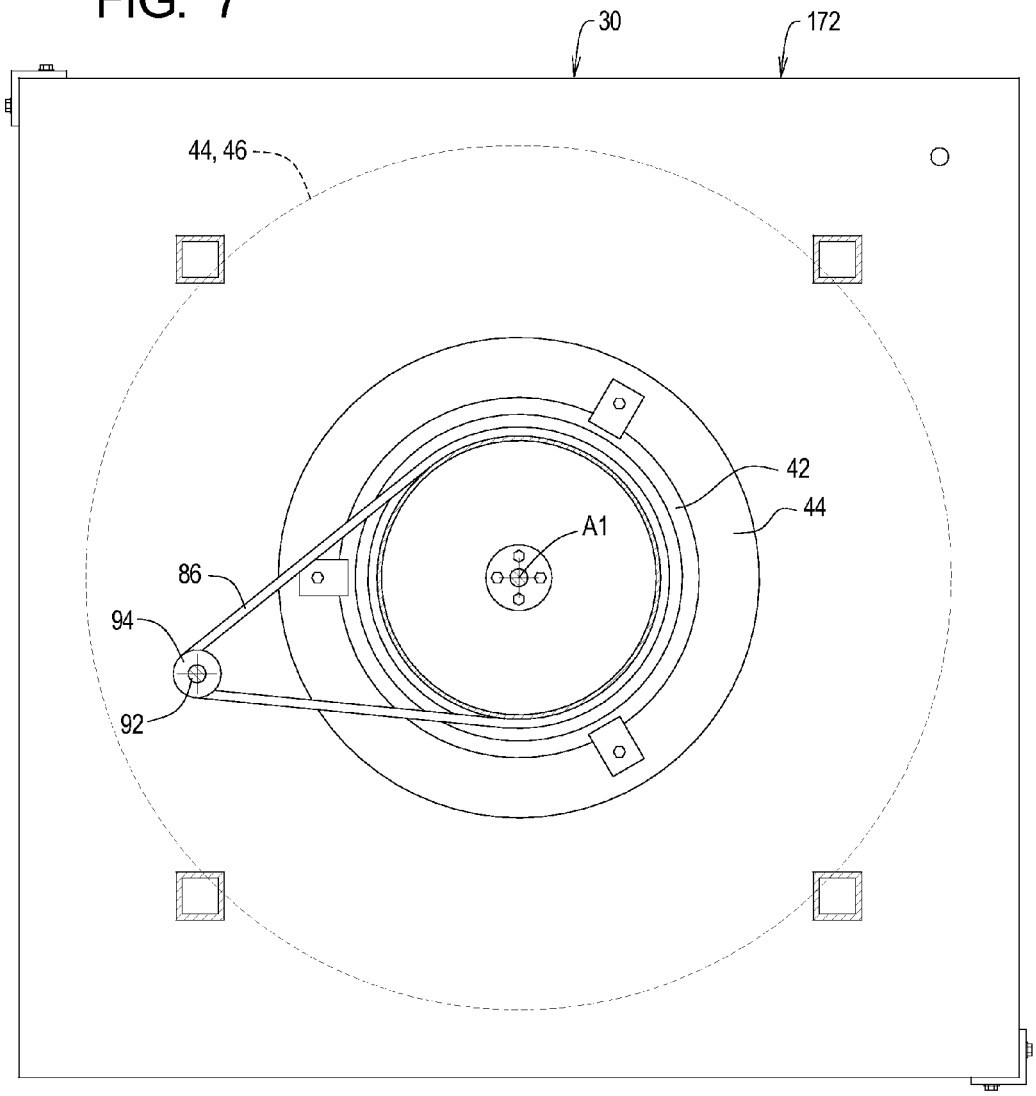
FIG. 7 is a section view taken along lines 7-7 in FIG. 2.
Figure 8:
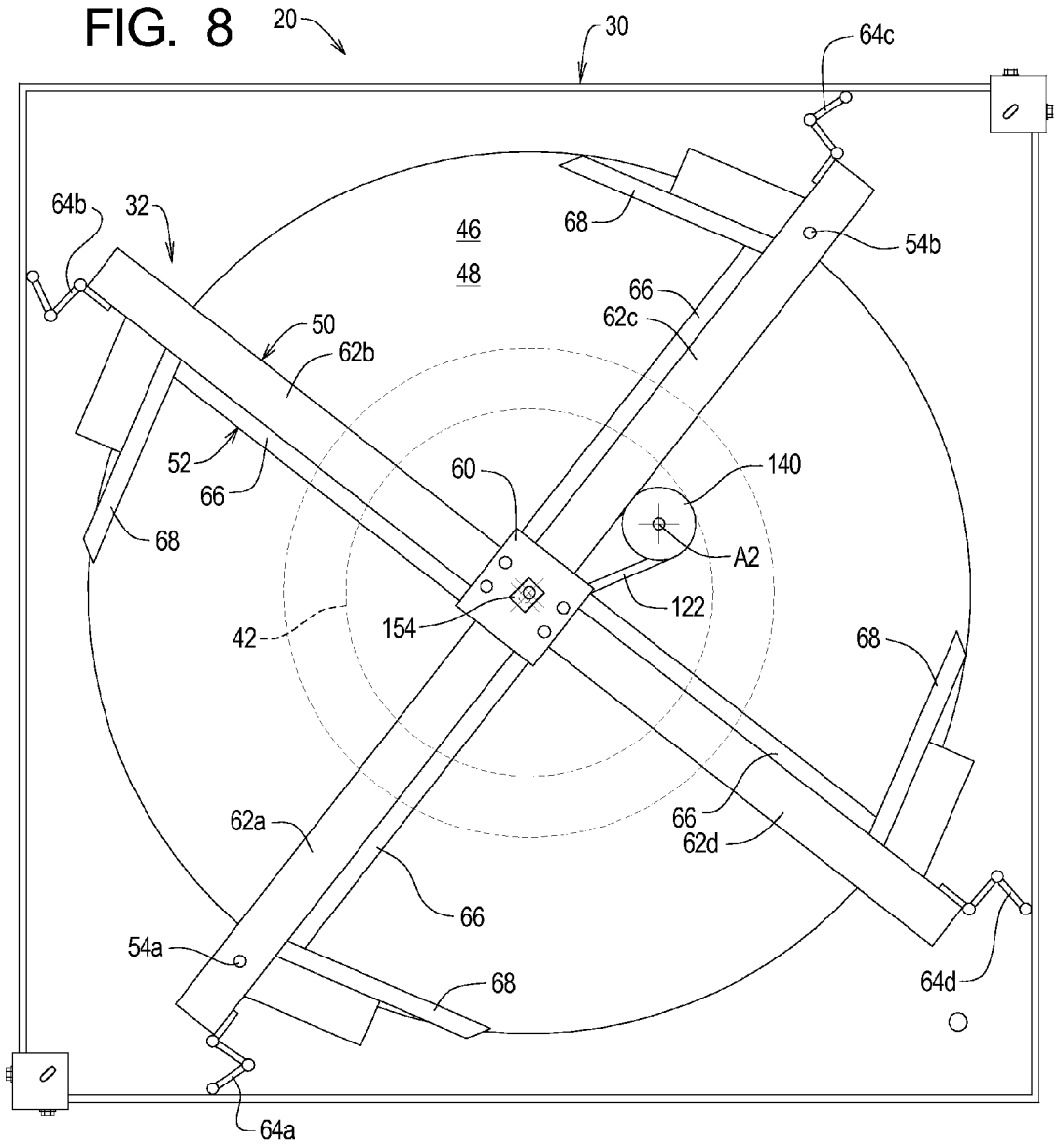
FIG. 8 is a top plan view illustrating a fence system of the example rock polishing system of the present invention.
Figure 9:
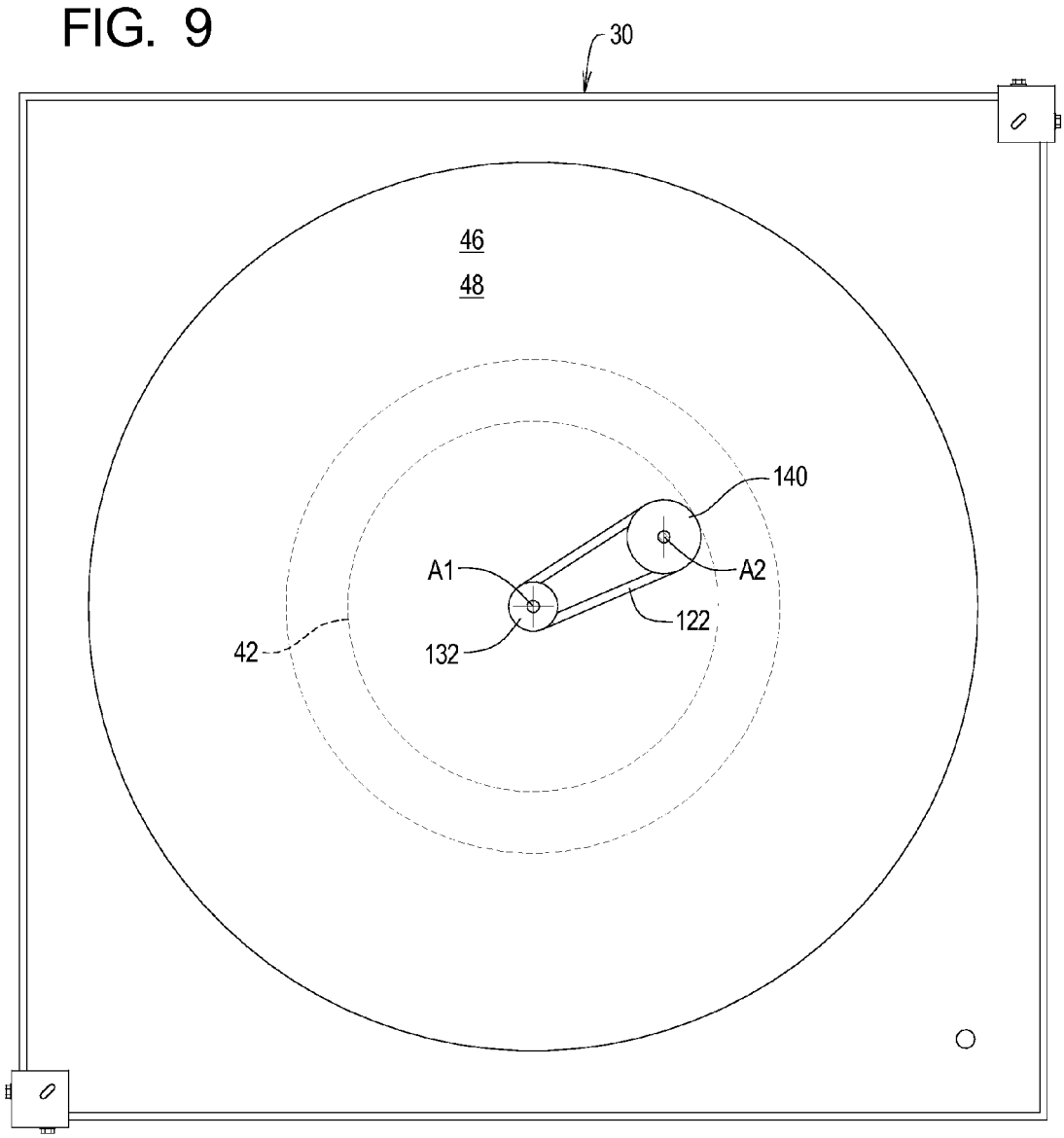
FIG. 9 is a top plan view of the example rock polishing system of the present invention illustrating a disc pulley assembly, first secondary drive belt, and secondary transmission shaft assembly.

Turning now to FIGS. 2, 5, and 6 of the drawing, the example support assembly 36 will be described in further detail. The exact details of the construction and operation of the support assembly 36 are not critical so long as the support assembly 36 supports the table system 30, fence system 32, and drive system 34 as described above.

The example support assembly 36 comprises a frame assembly 160 and a frame mounting system 162. The example frame assembly 160 comprises a leg assembly 170, a box assembly 172, table support members 174, a motor support member 176, and a transmission support member 178. The box assembly 172 provides a container for the table system 30 and supports the crossarm 50 of the fence system 32. The leg assembly 170 supports the box assembly 172 at a convenient vertical location for providing access to the polishing surface 48 and the rocks 22 thereon. The table support members 174 support the drum bearing 40. The motor support member 176 supports the motor 70. The transmission support member 178 supports a portion of the frame mounting assembly 162.

The example frame mounting assembly 162 comprises a mounting hinge 180, a mounting plate 182, a mounting cylinder 184, and an adjusting screw 186. In the example support assembly 36, the mounting hinge 180 rotatably attaches the mounting plate 182 to one of the legs forming the let assembly 170. The mounting cylinder 184 is supported by the transmission support member 178. The adjusting screw 186 extends through the mounting plate 182 and threadingly engages the mounting cylinder 184. Rotation of the adjusting screw 186 alters an angular position of the mounting plate 182 relative to the leg assembly 170 as shown by a comparison of FIGS. 5 and 6. The example frame mounting assembly 162 facilitates replacement of and adjustment of tension on the motor belt 82 and drum belt 86.

Figure 10:
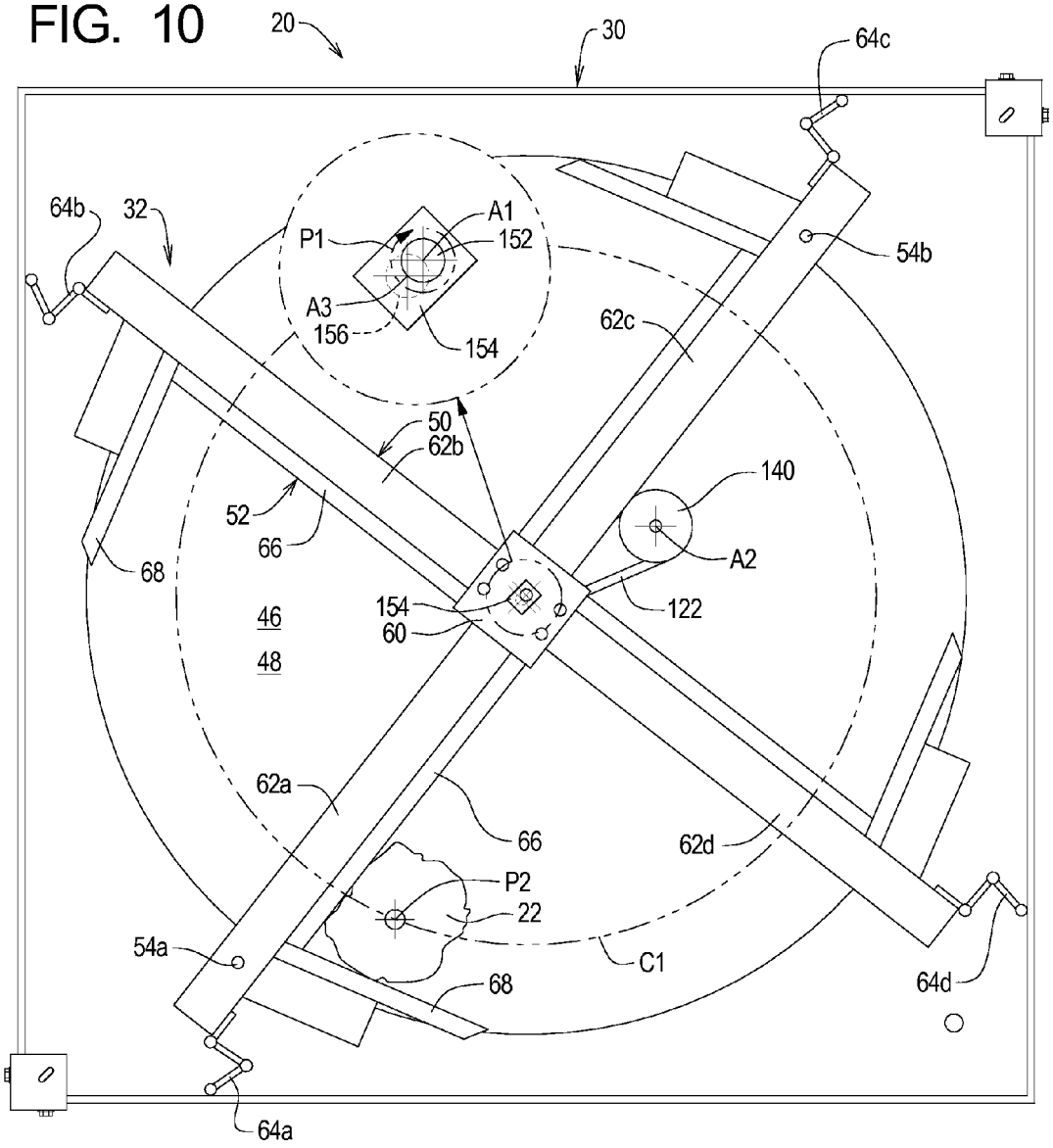
FIG. 10 is a top plan view of the fence system in a first position.
Figure 11:
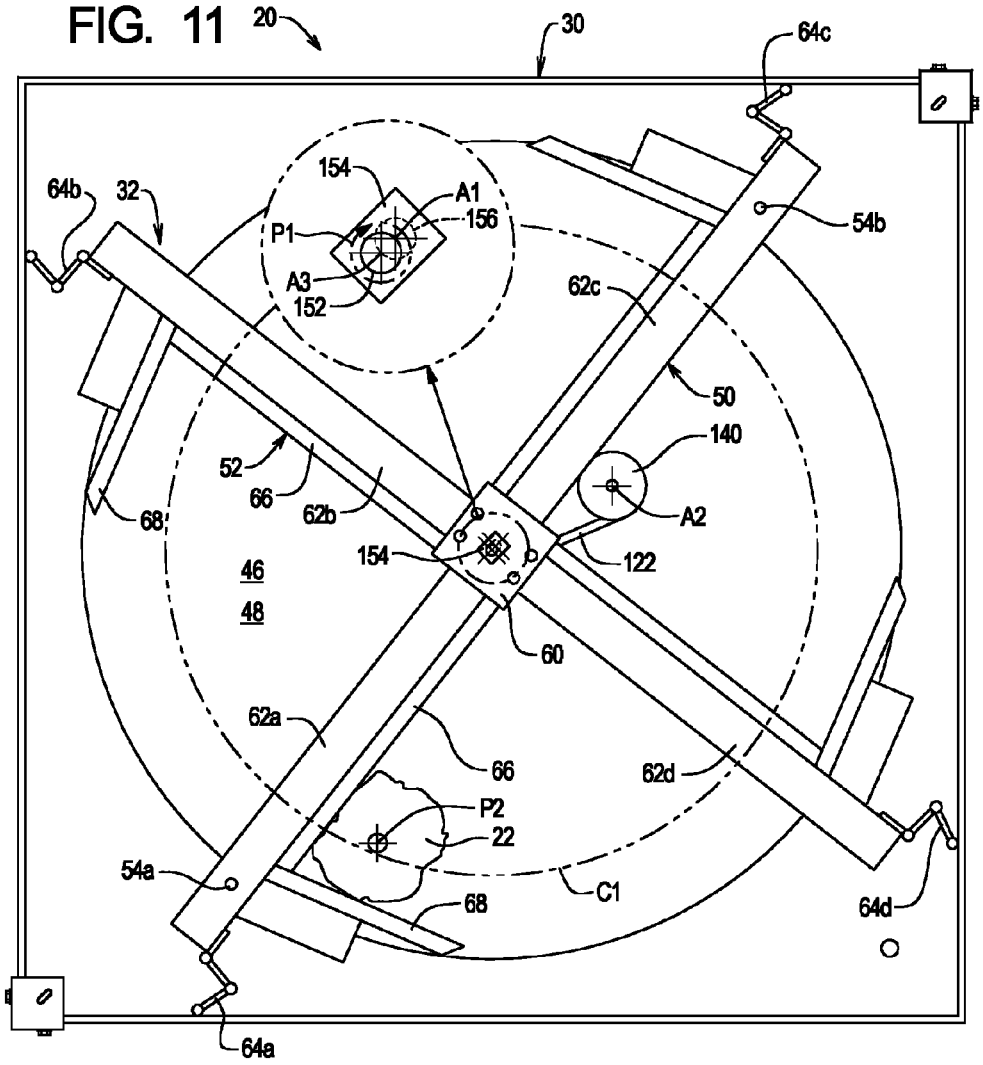
FIG. 11 is a top plan view of the fence system in a second position.

The operation of the example polishing system 20 will now be describe in further detail with respect to FIGS. 3, 10, and 11. Applying power to the motor 70 causes rotation of the motor pulley 80. The motor belt 82 transmits rotation of the motor pulley 80 to the first primary pulley 90. The primary drive shaft 92 transmits rotation of the first primary pulley 90 to the second primary pulley 94. The drum belt 86 transmits rotation of the second primary pulley 94 to the drive drum 42. Rotation of the drive drum 42 causes rotation of the support disc 44 and the polishing sheet 46 thereon.

Rotation of the support disc 44 is transmitted to the disc pulley 132 through the disc spindle 130. Rotation of the disc pulley 132 is in turn transmitted to the first secondary pulley 140 through the first secondary drive belt 122. Rotation of the first secondary pulley 140 is transmitted to the second secondary pulley 144 through the secondary drive shaft 142. The second secondary drive belt 126 transmits rotation of the second secondary pulley 144 to the fence pulley 150. Rotation of the fence pulley 150 is transmitted to the offset member 154 through the fence drive shaft 152. Rotation of the fence pulley 150 causes orbital movement of the orbital drive shaft 156 about the primary rotation axis A1 as generally described above.

As shown in FIGS. 10 and 11, orbital movement of the orbital drive shaft 156 is transmitted to the fence plate 60. In turn, orbital movement of the fence plate 60 causes the proximal ends of the fence arms 62 connected to the fence plate 60 to rotate along a circular path P1 centered about the primary rotation axis A1. The fence hinge assemblies 64 are configured to support the distal ends of the fence arms 62 to allow movement in any direction substantially parallel to the polishing surface 48 but to maintain the distal ends of the fence arms 62 at a desired location above the polishing surface 48.

While the motor 70 is operating, therefore, the polishing surface 48 is rotating underneath the fence system 32 and the fence arms 62 are moving back and forth slightly in directions substantially parallel to the polishing surface 48. The first fence boards 66 prevent the polishing surface 48 from carrying the rock(s) 22 thereon in a circular path as the support disc 44 rotates, and the second fence boards 68 prevent the rocks from moving radially away from the primary rotation axis A1 beyond a certain limit.

However, the slight back and forth movement of the fence arms 62 causes slightly back and forth movement of the rocks 22 in a direction towards and away from the primary rotation axis. This slight back and forth movement can be seen by a comparison of FIGS. 10 and 11. A reference circle C1 is depicted in FIGS. 10 and 11. In FIG. 10, a reference point P2 on the rock is located on the reference circle C1, and in FIG. 11 the reference point P2 has been displaced slightly inwardly relative to the reference circle C1.

The movement of the rocks 22 relative to the polishing surface 48 alters the position of the rocks 22 with respect to the polishing surface in a manner that inhibits the creation of grooves or visible patterns in the flat face 24.

What is claimed is:

1. A polishing system for polishing a flat face of a rock, comprising:

a polishing surface supported for rotation about a primary rotation axis;

a fence system supported above the polishing surface; and a drive system for causing the polishing surface to rotate about the primary rotation axis, and displacing a driven portion of the fence system along a circular path relative to the primary rotation axis, where the circular path traversed by the driven portion is centered about the primary rotation axis; wherein the fence system engages the rock to prevent the polishing surface from causing the rock to move about the primary rotation axis, and cause the rock to move towards and away from the primary rotation axis.

2. A polishing system as recited in claim 1, in which the fence system comprises:

a fence plate forming the driven portion of the fence system displaced by the drive system; and at least one fence arm operatively connected to the fence place such that movement of the fence plate cause movement of the at least one fence arm relative to the primary rotation axis; wherein the at least one fence arm is arranged to engage the rock.

3. A polishing system as recited in claim 2, in which the fence system further comprises at least one fence hinge configured to support the fence arm for movement relative to the primary rotation axis.

4. A polishing system as recited in claim 3, in which the fence system further comprises a crossarm rigidly supported relative to the primary location axis, where the crossarm is configured to support the fence plate.

5. A polishing system as recited in claim 3, further comprising a support assembly for supporting the polishing surface, the fence system, and the drive system.

6. A polishing system as recited in claim 1, in which:

the polishing surface is supported by a support disc; and the drive system comprises a motor, a primary transmission system operatively connected between the motor and the support disc, and a secondary transmission system operatively connected between the support disc and the driven portion of the fence system.

7. A method of polishing a flat face of a rock, comprising the steps of:

supporting a polishing surface for rotation about a primary rotation axis;

supporting a fence system above the polishing surface;

causing the polishing surface to rotate about the primary rotation axis;

displacing a driven portion of the fence system along a circular path relative to the primary rotation axis, where the circular path is centered about the primary rotation axis, such that the rock is prevented from moving about the primary rotation axis, and is caused to move towards and away from the primary rotation axis.

8. A method as recited in claim 7, further comprising the steps of:

providing a fence plate to form the driven portion of the fence system;

operatively connecting at least one fence arm to the fence place such that movement of the fence plate causes movement of the at least one fence arm relative to the primary rotation axis; and arranging the at least one fence arm to engage the rock.

9. A method as recited in claim 8, further comprising the step of arranging at least one fence hinge to support the fence arm for movement relative to the primary rotation axis.

10. A method as recited in claim 9, further comprising the step of rigidly supporting a crossarm relative to the primary location axis such that the cross arm supports the fence plate.

11. A method as recited in claim 7, further comprising the steps of:

providing a support disc for supporting the polishing surface;

operatively connecting a motor and the support disc; and operatively connecting the support disc and the driven portion of the fence system.

12. A polishing system for polishing a flat face of a rock, comprising:

a support assembly;

a table system comprising a support disc, and a polishing sheet secured to the support disc to define a polishing surface, where the support disc is supported for rotation relative to the support assembly;

a fence system comprising a fence plate, at least one fence arm rigidly connected at a first end to the fence plate, and at least one fence hinge connected between the at least one fence arm and the support assembly for movably supporting the fence arm above the polishing surface; and a drive system for causing the polishing surface to rotate about the primary rotation axis, and displacing a driven portion of the fence system along a path relative to the primary rotation axis; wherein the fence system engages the rock to prevent the polishing surface from causing the rock to move about the primary rotation axis, and cause the rock to move towards and away from the primary rotation axis.

13. A polishing system as recited in claim 12, in which the drive system displaces the driven portion of the fence system such that the driven portion traverses a circular path, where the circular path traversed by the driven portion is centered about the primary rotation axis.

14. A polishing system as recited in claim 12, in which the fence system further comprises a crossarm rigidly supported by the support assembly relative to the primary location axis, where the crossarm is configured to support the fence plate.

15. A polishing system as recited in claim 12, in which the drive system comprises:

a motor;

a primary transmission system operatively connected between the motor and the support disc; and a secondary transmission system operatively connected between the support disc and the driven portion of the fence system.

16. A polishing system as recited in claim 15, in which the driven portion of the fence system is the fence plate.

17. A polishing system for polishing a flat face of a rock, comprising:

a polishing surface supported for rotation about a primary rotation axis;

a fence system supported above the polishing surface, where the fence system comprises a fence plate forming the driven portion of the fence system displaced by the drive system, at least one fence arm operatively connected to the fence place such that movement of the fence plate cause movement of the at least one fence arm relative to the primary rotation axis, and at least one fence hinge configured to support the fence arm for movement relative to the primary rotation axis, where the at least one fence arm is arranged to engage the rock; and a drive system for causing the polishing surface to rotate about the primary rotation axis, and displacing a driven portion of the fence system along a path relative to the primary rotation axis; wherein the fence system engages the rock to prevent the polishing surface from causing the rock to move about the primary rotation axis, and cause the rock to move towards and away from the primary rotation axis.

18. A polishing system as recited in claim 17, in which the fence system further comprises a crossarm rigidly supported relative to the primary location axis, where the crossarm is configured to support the fence plate.

19. A polishing system as recited in claim 18, further comprising a support assembly for supporting the polishing surface, the fence system, and the drive system.

20. A method of polishing a flat face of a rock, comprising the steps of:

supporting a polishing surface for rotation about a primary rotation axis;

supporting a fence system above the polishing surface;

causing the polishing surface to rotate about the primary rotation axis;

displacing a driven portion of the fence system along a path relative to the primary rotation axis such that the rock prevented from moving about the primary rotation axis, and is caused to move towards and away from the primary rotation axis;

providing a fence plate to form the driven portion of the fence system;

operatively connecting at least one fence arm to the fence place such that movement of the fence plate causes movement of the at least one fence arm relative to the primary rotation axis;

arranging the at least one fence arm to engage the rock; and arranging at least one fence hinge to support the fence arm for movement relative to the primary rotation axis.

21. A method as recited in claim 20, further comprising the step of rigidly supporting a crossarm relative to the primary location axis such that the cross arm supports the fence plate.

* * * * *